United States Patent [19]

Baigent

[11] Patent Number: 4,610,486

[45] Date of Patent: Sep. 9, 1986

[54] STRUCTURAL BEARING ASSEMBLY

[75] Inventor: Maurice G. Baigent, Ilminster, England

[73] Assignee: Aeplc, England

[21] Appl. No.: 716,856

[22] Filed: Mar. 28, 1985

[30] Foreign Application Priority Data

Mar. 30, 1984 [GB] United Kingdom ..... 8408248

[51] Int. Cl.[4] ..... F16C 29/02; F16C 33/10; E01D 19/06

[52] U.S. Cl. ..... 384/7; 14/16.1; 384/13

[58] Field of Search ..... 308/3 R, 5 R; 384/100, 384/121, 123, 124, 155, 368–371, 305, 303, 307, 322, 311; 52/167; 14/16.1, 17; 248/544, 349, 638; 184/5, 105

[56] References Cited

U.S. PATENT DOCUMENTS

| | | | |
|---|---|---|---|
| 3,728,752 | 4/1973 | Andra et al. | 308/3 R X |
| 3,806,975 | 4/1974 | Fyfe | 308/3 R X |
| 3,995,915 | 12/1976 | Koster | 308/3 R |
| 4,238,137 | 12/1980 | Furchak et al. | 308/3 R |
| 4,320,549 | 3/1982 | Greb | 308/3 R X |

FOREIGN PATENT DOCUMENTS

| | | | |
|---|---|---|---|
| 2221247 | 4/1973 | Fed. Rep. of Germany | 14/16.1 |
| 2252289 | 5/1974 | Fed. Rep. of Germany | 14/16.1 |
| 2953312 | 8/1981 | Fed. Rep. of Germany | 14/16.1 |
| 1529803 | 5/1968 | France | 14/16.1 |
| 1077604 | 8/1967 | United Kingdom | 308/3 R |
| 2031501 | 4/1980 | United Kingdom | 14/16.1 |

*Primary Examiner*—Stuart S. Levy
*Assistant Examiner*—Thomas R. Hannon
*Attorney, Agent, or Firm*—Price, Heneveld, Huizenga & Cooper

[57] ABSTRACT

A structure bearing assembly comprising a retaining plate housing a circular center plate the upper surface of which has a PTFE bearing layer and a number of lubricant grooves which may be straight or circular. The grooves each have an opening at both ends for the introduction and/or removal of lubricant.

17 Claims, 8 Drawing Figures

STRUCTURAL BEARING ASSEMBLY

BACKGROUND OF THE INVENTION

The present invention relates to a structural bearing assembly, in particular a lubricated structural bearing assembly which might be used for example as a bridge bearing.

Structural bearings having a sliding layer of polytetrafluoroethylene (PTFE) are known. These are generally used in conjunction with a stainless steel contact plate or possibly a second PTFE surface. Frequently, these are lubricated by providing dimples in the PTFE surface and filling these dimples with lubricant.

It has been observed that such bearings have sometimes resulted in difficulties particularly when the total cumulative movement between the sliding surfaces is large. In some instances, the lubrication effect is reduced leading to high friction between the sliding surfaces.

In utilising plastics materials such as PTFE, the problem of cold flow of the material under load can present problems if the lubricant is diminished. In the case of PTFE this danger exists since, the lubricating channels in the bearing surfaces can become blocked due to cold flow as the lubricant is depleted.

SUMMARY OF THE INVENTION

It is an object of the present invention to provide a structural bearing assembly in which lubrication can be carried out periodically throughout the life of the structure, and without the need to remove the load from the bearing.

It is a further object of the invention to provide an assembly in which the lubricant can be changed even after the bearing has been put in place.

According to the invention a structural bearing assembly comprises a support, a bearing layer on the support and a series of elongate channels in the bearing layer, each channel having an opening at each end for the introduction and removal of lubricant material. Preferably the bearing layer cooperates with a stainless steel or PTFE plate to define the sliding surfaces. Preferably, the bearing layer comprises PTFE. The PTFE layer may be attached to a centre plate which in turn may be located by means of a support plate.

Preferably, the sliding surfaces are planar and the channels in the bearing layer are preferably circular and concentric, though they may be straight.

Preferably the lubricant entries to the channels are each supplied by separate inlets, alternatively, the lubricant entries to the channels may be joined by common passage into which lubricant may be introduced. The exits from the channels may also be joined by a common outlet passage or they may communicate with separate lubricant outlets which preferably have independently operable valves. Thus, in all cases it may be possible to admit a solvent or fresh lubricant to the channels in turn. This, of course, can be carried out throughout the life of the structure in which the bearing is located, and so, old grease may also be replaced with new by this method.

The channels may be formed by inserts which are located between annuli or strips of PTFE forming the bearing layer. In such a construction, the annuli or strips are preferably attached to the support. Alternatively, the inserts may be embedded in the bearing layer. However, in a preferred embodiment, the channels are simply machined out of the support surface and annuli or strips of the bearing material are located between the channels to define the bearing layer.

These constructions are believed to show less likelihood of cold flow of the bearing material closing the channels, e.g. when old lubricant is actually removed prior to its replacement, as compared with an arrangement in which the channels are machined from the bearing layer. This may be particularly important where very old, hard grease is to be replaced. If the old grease is very hard, it cannot simply be "pushed out" by fresh grease, rather, the fresh grease bores a channel through the old grease. Thus, a solvent must be used to flush out the old grease, leaving the channel empty for a time prior to the admission of fresh lubricant.

The invention may be carried into practice in various ways and some embodiments will now be described by way of example with reference to the accompanying drawings

DESCRIPTION OF PREFERRED EMBODIMENTS

Figure 1:
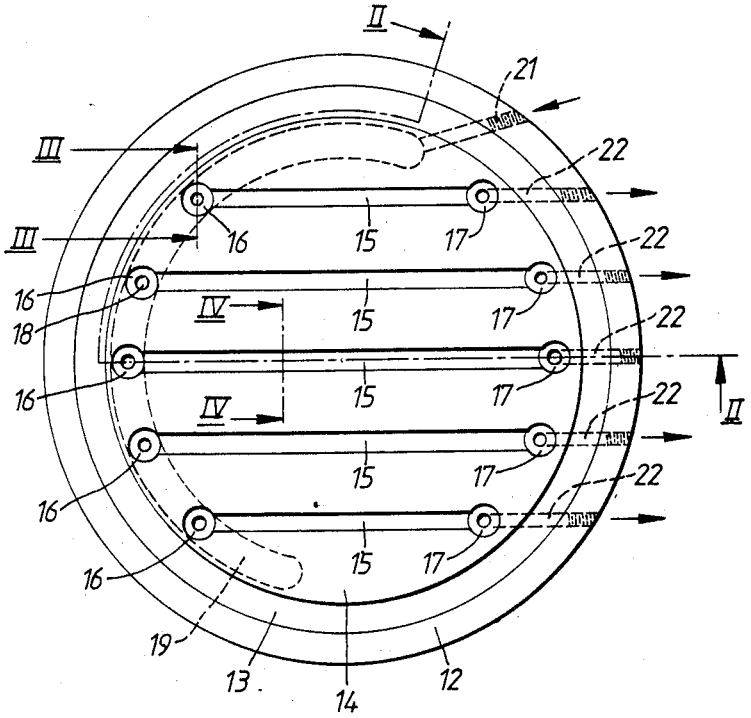
FIG. 1 is a top plan view of a structural bearing assembly in accordance with the invention.
Figure 2:
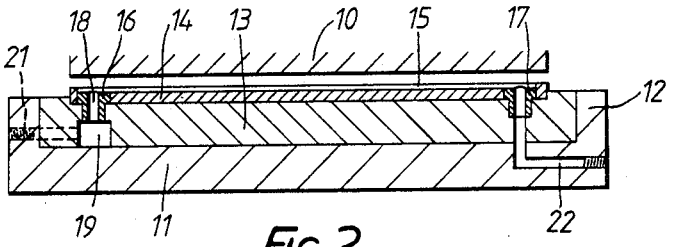
FIG. 2 is a vertical cross-section on the line II—II of FIG. 1.

Referring firstly to FIGS. 1 and 2 these figures show the lower part of a bridge bearing assembly in accordance with the invention. Beneath a stainless steel contact plate 10, the assembly comprises a metal retaining plate 11 which is circular and has an upturned peripheral lip 12 which locates a mild steel centre plate 13. The upper surface of the centre plate 13 is provided with a polytetrafluoroethylene (PTFE) bearing layer 14 which has a number of straight parallel lubricant grooves 15.

Each groove 15 has at one end an inlet nozzle 16 and at the other end an outlet nozzle 17. Each inlet nozzle 16 has a bore 18 which opens into its groove 15 and which at the other end opens into a lubricant channel 19. The channel 19 is formed in the centre plate 13 and is generally arcuate, connecting the bores 18 of each inlet nozzle 16. There is then a passage 21 from the channel 19 to the outside of the retaining plate 11 which constitutes a lubricant inlet.

The outlet nozzles 17 are of similar construction to the inlet nozzles 16 but each connects its lubricant groove with a simple outlet passage 22. The series of outlet passages 22 and the lubricant inlet 21 are arranged to be within approximately a 120° arc for ease of access from one side of the bearing.

Figure 3:
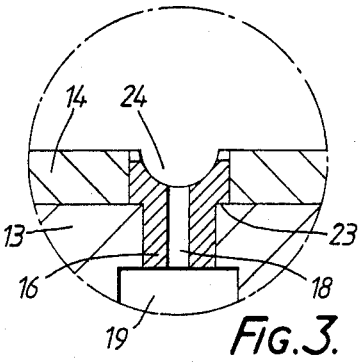
FIG. 3 is a detail of a vertical section on the line III—III in FIG. 1.

The actual construction of the inlet nozzle 16 is shown in FIG. 3. As can be seen, the nozzle 16 is generally circular when viewed from above and has a shoulder 23 which rests upon the centre plate 13 through which the nozzle body extends. The upper part of the nozzle 16 terminates a little below the upper surface of the PTFE bearing layer 14. The top surface of the nozzle 16 has a part-cylindrical depression 24 which extends in the direction of the groove 15.

The construction of the outlet nozzle 17 is similar, but, as stated above, communicates with its own outlet passage 22 rather than with a common channel 19.

Figure 4:
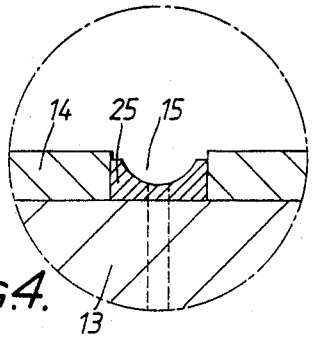
FIG. 4 is a detail of a vertical section on the lines IV—IV in FIG. 1.

The lubricant groove 15, as shown in FIG. 4, is defined by an elongate insert 25 of plastics material or metal which terminates just below the level of the bearing layer 14 (or alternatively flush with the surface of the bearing layer 14). The base of the insert 25 is attached to the upper surface of the centre plate 13. Thus, the insert 25 effectively acts as a spacer between two strips of PTFE.

Figure 5:
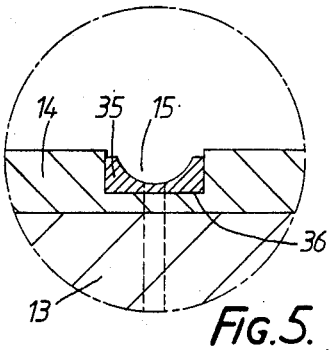
FIGS. 5 and 6 are views similar to FIG. 4 showing two alternative variants of the grease channels.
Figure 6:
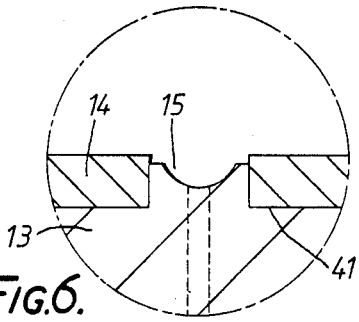

An alternative construction of the grooves 15 is shown in FIG. 5 in which a somewhat shallower insert 35 is located in a channel 36 formed in the bearing layer 14. Yet another variant embodiment is shown in FIG. 6 in which strips of the bearing layer 14 are located in suitably formed recesses 41 in the surface of the centre plate 13 the recesses 41 are a little shallower than the thickness of the bearing layer so that the bearing layer stands somewhat proud of the exposed surface of the centre plate 13. The groove 15 is machined out of the surface of the centre plate 13.

In all three embodiments it is preferable that the surface of the bearing layer stands somewhat proud in the region of the groove 15 in order to avoid the PTFE of the bearing layer extruding by cold flow into the grooves 15, thereby closing them off.

In an alternative version (not shown) the inlet and the outlet nozzles 16,17 are screwed through the insert 25 or 35 and into the retaining plate 11 beneath. This helps to ensure that cold flow of the PTFE does not close off the inlet and outlet nozzles 16, 17.

In use, lubricant, usually grease, is pumped through the inlet 21 and enters the channel 19 under pressure. One of the outlet passages 22 is then opened and lubricant flows into the corresponding groove 15. Should there by any old lubricant in the groove 15 at this time it will be carried out via the outlet nozzle 17 and the outlet passage 22. The outlet passage 22 is then closed and the procedure repeated for the remaining grooves 15 in turn. If old, hard lubricant is to be replaced, it can first be removed using a solvent and fresh lubricant can then be introduced into the grooves 15.

Figure 7:
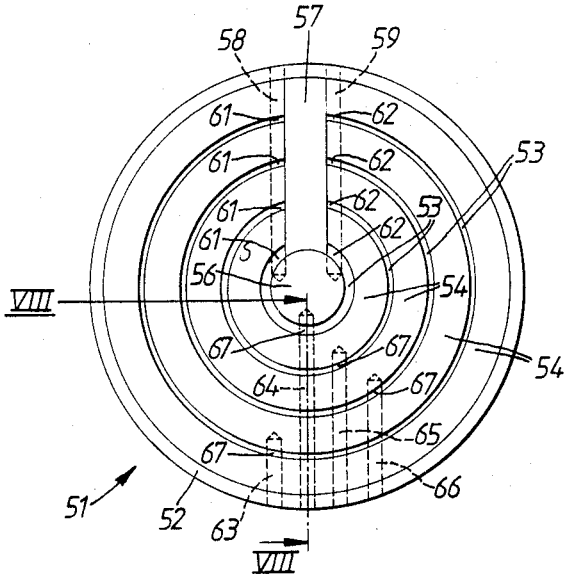
FIG. 7 is a view similar to FIG. 1 showing a second embodiment of the invention.
Figure 8:
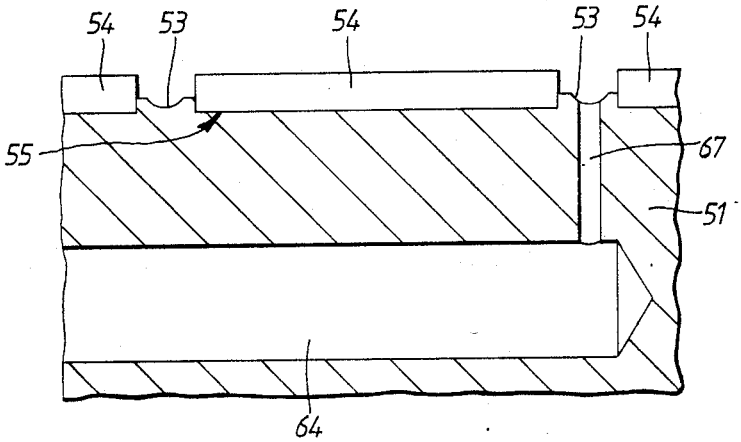
FIG. 8 is a part vertical section on the line VIII—VIII in FIG. 7.

In the embodiment shown in FIGS. 7 and 8, the assembly includes a single circular metal support plate 51 which takes the place retaining plate 11 and centre plate 13 of the first embodiment. The plate 51 has a peripheral lip 52 and a series (in this case, four) of concentric circular grooves 53 machined into its upper surface. Between the grooves 53, annular PTFE bearing members 54 are located in recesses 55 in the plate 51 and stand proud of the surface of the plate 51. A round disc 56 of PTFE is located at the centre of the plate 51.

The grooves 53 are not continuous but are interrupted by a PTFE strip 57 running from the lip 52 to the disc 56 thus defining two ends for each grooves 53. Two inlet/outlet channels 58,59 are formed in the plate 51, one to each side of the strip 57, and inlet/outlet bores 61,62 extend from the channels 58,59 to respective grooves 53, so that each groove 53 has an inlet/outlet bore at both ends.

In addition, individual inlet/outlet passages 63,64,65 and 66 are formed in the plate 51, each of which communicates with one of the grooves 53 through a further inlet/outlet bore 67.

In use, the lubricant can be pumped into either of the two channels 58,59 (with the passages 63 to 66 closed off) or may be pumped into passages 63 to 66. The grooves 53 can be filled individually by selectively closing or operating the passages 63 to 66. Similarly, solvent may be pumped into any or all of the grooves 53 to remove old lubricant.

Obviously numerous modifications and variations of the present invention are possible on the light of the above teachings. It is therefore to be understood that within the scope of the appended claims, the invention may be practiced otherwise than as specifically described herein.

I claim:

1. A structural bearing assembly comprising: support means, a bearing surface on said support means, said bearing surface being formed by a layer of a bearing material capable of cold flow under loads for which the bearing is designed, a contact plate in engagement with said bearing surface thereby defining the sliding surfaces of said bearing assembly, said bearing surface of said bearing material being the only load supporting surface contacting said contact plate; said bearing surface being interrupted by a series of elongate channels, each of said channels having an opening at each end for the introduction and removal of a lubricant material, means occupying each of said channels, each of said means having a base portion and upstanding side portions, said base portion and said side portions being formed of a material which is harder than that of said bearing surface and capable of resisting any cold flow lateral pressure exerted there against.

2. An assembly according to claim 1 wherein the said contact plate has a stainless steel surface.

3. An assembly according to claim 1 wherein said bearing layer is of polytetrafluoroethylene.

4. An assembly according to claim 1 wherein said channels are generally circular and concentric.

5. An assembly according to claim 1 wherein said means are insert liners, channels and liners being straight.

6. An assembly according to claim 5 wherein said means comprise inserts located in the channels between areas of the bearing material.

7. An assembly according to claim 1 wherein the upper surface of said support plate has a plurality of recesses for receiving bearing material, and recesses being separated by upstanding ridges extending into said channels, lubricant grooves formed in the upper surface of said ridges.

8. An assembly according to claim 1 wherein said base portion and said side portions of said means in said channels merge to form an upwardly directed groove of a smooth cross-sectional curve.

9. An assembly according to claim 8 wherein said means in said channels each have an additional opening located intermediate said openings at each end, said assembly also including a series of separate passages, each communicating with one of said additional openings.

10. An assembly according to claim 1 further including a conduit, said conduit communicating with and joining said openings at one end of each of said channels.

11. A structural bearing assembly comprising: support means, a bearing surface on said support means, said bearing surface being formed by a layer of a bearing material capable of cold flow under loads for which the bearing is designed, a contact plate in engagement with said bearing surface thereby defining the sliding surfaces of said bearing assembly, said bearing surface of said bearing material being the only load supporting surface contacting said contact plate; said bearing surface being interrupted by a series of straight elongate channels, each of said channels having an opening at each end for the introduction and removal of a lubricant material, means occupying each of said channels, said means being formed at least in part of a material which is harder than that of said bearing surface and capable of resisting any cold flow generated lateral pressure exerted there against.

12. An assembly according to claim 11 wherein said means comprise inserts located between adjacent areas of bearing material.

13. A structural bearing assembly comprising: support means, a bearing surface on said support means, said bearing surface being formed by a layer of a bearing material capable of cold flow under loads for which the bearing is designed, a contact plate in engagement with said bearing surface thereby defining the sliding surfaces of said bearing assembly, said bearing surface of said bearing material being the only load supporting surface contacting said contact plate; said bearing surface being interrupted by a series of generally circular concentric channels, each of said channels having an opening at each end for the introduction and removal of a lubricant material, means occupying each of said channels each of said means having a base portion and upstanding side portions defining a lubricant groove in the upper face of said means and being formed of a material which is harder than that of said bearing surface.

14. A structural bearing comprising: a rigid support means; a bearing surface on said support means formed of a layer of a bearing material capable of cold flow under loads for which the bearing is designed; a load applying contact plate seated on and in bearing contact with said bearing surface and defining the sliding surfaces of said bearing assembly; a plurality of channels in said bearing surface and rigid means in each of said channels having a lubricant groove in its upper face flanked on each side by upstanding side members, the tops of said side members being recessed a small distance below the upper surface of said bearing material whereby the surface of said bearing material is the only surface in contact with said contact plate; the sides of said rigid means being capable of resisting any cold flow lateral pressure exerted against them by said bearing material; means at opposite ends of said channel for supplying and discharging lubricant from said channels.

15. A structural bearing as described in claim 14 wherein said rigid means are upstanding ridges integral with said support means.

16. A structural bearing as described in claim 14 wherein said rigid means are elongated, strip-like inserts seated in each of said channels.

17. A structural bearing as described in claim 14 wherein said bearing material has cold flow properties generally similar to PTFE.

* * * * *